United States Patent [19]

Hintikka et al.

[11] 4,317,715

[45] Mar. 2, 1982

[54] PROCESS FOR THE SELECTIVE FROTH-FLOTATION OF PHOSPHATE AND CARBONATE MINERALS FROM FINELY-DIVIDED PHOSPHATE-CARBONATE-SILICATE ORES OR CONCENTRATES

[75] Inventors: Väinö V. H. Hintikka, Pori; Kaarlo M. J. Saari, Vanha-Ulvila, both of Finland

[73] Assignee: Outokumpu Oy, Helsinki, Finland

[21] Appl. No.: 207,339

[22] Filed: Nov. 14, 1980

Related U.S. Application Data

[63] Continuation of Ser. No. 957,460, Nov. 3, 1978, abandoned.

[30] Foreign Application Priority Data

Nov. 22, 1977 [FI] Finland ..... 773533

[51] Int. Cl.[3] ..... B03D 1/02

[52] U.S. Cl. ..... 209/167; 209/166

[58] Field of Search ..... 209/166, 167

[56] References Cited

U.S. PATENT DOCUMENTS

| | | | |
|---|---|---|---|
| 1,488,745 | 4/1924 | Ellis | 209/166 |
| 2,105,807 | 11/1938 | Crago | 209/167 |
| 2,313,360 | 3/1943 | Ralston | 209/166 |
| 3,259,242 | 7/1966 | Snow | 209/166 |
| 3,462,017 | 8/1969 | Bushell | 209/116 |
| 3,482,688 | 12/1969 | Bushell | 209/166 |
| 4,059,509 | 11/1977 | Eisenhardt | 209/166 |
| 4,144,969 | 3/1979 | Snow | 209/166 |

*Primary Examiner*—Robert Halper

*Attorney, Agent, or Firm*—Brooks, Haidt, Haffner & Delahunty

[57] ABSTRACT

A process for the separate recovery of phosphate and carbonate minerals from finely-divided phosphate-carbonate-silicate ores or concentrates with a carbonate to phosphate ratio of over 1 is disclosed, in which an anionic collector agent is added to an aqueous slurry of these ores and concentrates, the slurry is then exposed to froth-flotation in order to separate a silicate-bearing residue from phosphate-carbonate concentrate, thereafter (a) the combined phosphate-carbonate concentrate is either treated with a base in order to remove the collector-agent coatings from the surfaces of the mineral particles, whereafter the combined concentrate is froth-flotated with a cationic collector agent using a depressing agent for carbonate in order to recover the phosphate concentrate and the carbonate concentrate separately, or (b) the aqueous slurry to which the anionic collector agent has been added and which has been froth-flotated is treated with sulfur dioxide or carbon dioxide in order to inactivate the collector-agent coatings on the surfaces of the carbonate minerals, whereafter the slurry is froth-flotated in order to obtain separately recovery of a phosphate concentrate and a carbonate concentrate.

4 Claims, 2 Drawing Figures

PROCESS FOR THE SELECTIVE FROTH-FLOTATION OF PHOSPHATE AND CARBONATE MINERALS FROM FINELY-DIVIDED PHOSPHATE-CARBONATE-SILICATE ORES OR CONCENTRATES

This is a continuation, of application Ser. No. 957,460, filed Nov. 3, 1978 now abandoned.

BACKGROUND OF THE INVENTION

The present invention relates to a process for the separate recovery of phosphate and carbonate minerals from finely-divided phosphate-carbonate-silicate ores or concentrates in which the carbonate to phosphate ratio is over 1, in which case an anionic collector agent is added to an aqueous slurry of these ores or concentrates and the slurry is possibly exposed to froth-flotation in order to separate a silicate-bearing residue from the combined phosphate-carbonate concentrate.

It is known that carbonate and phosphate minerals can be froth-flotated to produce a combined concentrate, using a fatty-acid type collector agent, the silicates remaining in the residue. The yield of carbonate and phosphate minerals in the combined concentrate can be improved, and at the same time the quantity of collector agent can be decreased by using various emulsifiers, neutral oil, or hot preparation in connection with the pre-flotation or grinding. By repeating the froth-flotation of the pre-concentrate several times, a combined concentrate with a purity degree of 90–95% has been obtained. The yields of carbonates and phosphates in this product have been high, 85–90% (carbonates) and 95–98% (phosphates).

When phosphates and carbonates have been froth-flotated selectively to produce separate concentrates, as a result of the high yield the phosphate concentrate has, however, contained carbonates and the carbonate concentrate has contained phosphates.

The separate recovery of carbonates and phosphates from a combined concentrate or the purification of a phosphate or carbonate concentrate obtained by selective froth-flotation causes difficulties and is unselective in conventional processes, which results in relatively high losses of phosphate in the carbonate concentrates. Neither is the concentration of the phosphate concentrate satisfactory, owing to the carbonates remaining in it.

U.S. Pat. No. 3,259,242 discloses a process for exposing a phosphate-carbonate-silicate ore to anionic froth-flotation at a pH value above 7 in order to recover a combined phosphate-carbonate concentrate and to treat this combined concentrate with an acid in order to remove the anionic froth-flotation reagent so that the combined concentrate can thereafter be exposed to cationic froth-flotation at a pH above 7 in order to produce a phosphate concentrate substantially devoid of carbonate. This process can be applied to the treatment of ores with a relatively low carbonate to phosphate ratio, at maximum 1. The process according to this patent is not, however, suitable for the selective froth-flotation of ores which contain substantially more carbonate than phosphate.

In the U.S. Pat. Nos. 3,462,016 and 3,462,017 it has been disclosed a method, in which a combined carbonate-phosphate concentrate, froth-flotated by fatty-acid, is treated with $H_3PO_4$ or with $NH_4H_2PO_4$. Herethrough the phosphates become inactive to froth-flotation, whereas the carbonates are froth-flotated in spite of the treatment. In this way the carbonate concentrate and the phosphate concentrate can be separated from the combined carbonate-phosphate concentrate.

It is furthermore known a method (Inst. Mining Met. Trans., Sect. C 75 (718), 233–9, 1966), in which it is used analogically with the former ones $NaH_2PO_4$ or $CaHPO_4$ as the depressor of phosphate minerals in the separation of carbonate and phosphate concentrates from their combined concentrate.

A disadvantage of the above-mentioned methods is their poor economy ($H_3PO_4$ and its salts are relatively expensive) and their low selectivity, as the phosphates having better froth-flotating properties are depressed and the carbonates having slighter froth-flotating properties are froth-flotated. From this naturally follows a low selectivity, as a part of the phosphates is always rising to the carbonate concentrate and a part of the carbonates remain unflotated in the phosphate concentrate.

The object of the present invention is to provide a process for the separate recovery, with a good yield, of phosphate and carbonate minerals from phosphate-carbonate-silicate ores and concentrates which contain more carbonate than phosphate. The selective froth-flotation of phosphate-carbonate-silicate ores and concentrates which contain more carbonate than phosphate has proven to be highly problematic, and the object of the present invention is to overcome these difficulties.

SUMMARY OF THE INVENTION

In the process according to the invention, an anionic collector agent is first added to an aqueous slurry of the ores or concentrates. Thereafter the slurry is preferably exposed to froth-flotation in order to separate a silicate-bearing residue from the combined phosphate-carbonate concentrate by a method known per se. Thereafter there are two alternative procedures for the treatment of the combined carbonate-phosphate concentrate.

According to the first alternative 1A, the collector agent adsorbed onto the surfaces of the mineral particles is removed using a base. Previously the adsorbed collector agent was removed by means of an acid. In the process according to the present invention, in which ores and concentrates relatively rich in carbonate and froth-flotated, the adsorbed collector agent is, however, removed using a base, whereafter the combined concentrate is exposed to selective froth-flotation with a cationic collector agent, using some carbonate-depressing agent known per se.

According to the second alternative 1B of the process according to the invention, which is especially suitable for phosphate-low ores and concentrates, the froth-flotation is performed using the former adsorbed anionic collector agent after this adsorbed collector agent has been selectively inactivated on the surfaces of carbonate minerals using sulfur dioxide and/or carbon dioxide.

This second alternative is especially economical since it can be carried out using a very small quantity of collector agent, a factor which is important when treating ores and concentrates with a very low phosphate content.

According to a particularly advantageous embodiment 2 of the second alternative of the invention phosphate-carbonate-silicate ore is at first pre-treated at two stages, whereby there is added to the first pre-treatment anionic collector and emulgator and to the second pre-treatment $CO_2$ and/or $SO_2$. After this a selective froth-flotation is carried out, whereby the phosphate concentrate and the carbonate silicate residue is separated. The carbonates can be separately recovered from the residue, if it is economically profitable.

This embodiment is even simpler than the second alternative (1B) disclosed.

Thus according to the present invention, an agent which selectively prevents the collector agent from causing the surfaces of the carbonate mineral to become hydrophobic, or which inactivates the collector agent already present on these surfaces, is added to the aqueous slurry of the carbonate-phosphate ore or concentrate.

DESCRIPTION OF THE PREFERRED EMBODIMENTS

The collector agent used for phosphate minerals is any cationic or anionic collector agent suitable for this purpose; the appropriate selection and use of such an agent is one of the skills of an expert in the field. The depressor used for carbonate minerals is, according to the present invention, waterglass, carbon dioxide and/or sulfur dioxide, alum, aluminum sulfate, potassium sulfate, quebracho, dichromate and/or a fluorine compound.

According to the second alternative of the present invention, combined carbonate-phosphate concentrates pre-flotated with a fatty-acid collector agent are treated with carbon dioxide and/or sulfur dioxide in order to inactivate the fatty acids on the carbonate mineral surfaces, whereafter the final froth-flotation is performed in accordance with the present invention. If the fatty acids have been inactivated with sulfur dioxide or carbon dioxide and the collector agent which has been used is anionic, such as a fatty-acid type collector agent, then no depressor for carbonate is required in the final froth-flotation, since the fatty-acid collector agent no longer causes the carbonate mineral surfaces to become hydrophobic.

When combined carbonate-phosphate concentrate is treated with a base according to the first alternative of the process according to the present invention, a depressor for carbonate is required, its quantity being dependent on the carbonate to phosphate ratio in the concentrate or ore so that the higher the ratio the higher the required quantity of the depressor. After pre-treatment with a carbonate-depressing agent the pH value is usually neutral. Thereafter the phosphates are froth-flotated with an amine or fatty-acid type collector agent, whereby the phosphates are froth-flotated selectively and the carbonates remain in the froth-flotation residue. Froth-flotation with amine is most successful when the pH is neutral or mildly acid. In fatty-acid froth-flotation the pH is not equally decisive.

Figure 1:
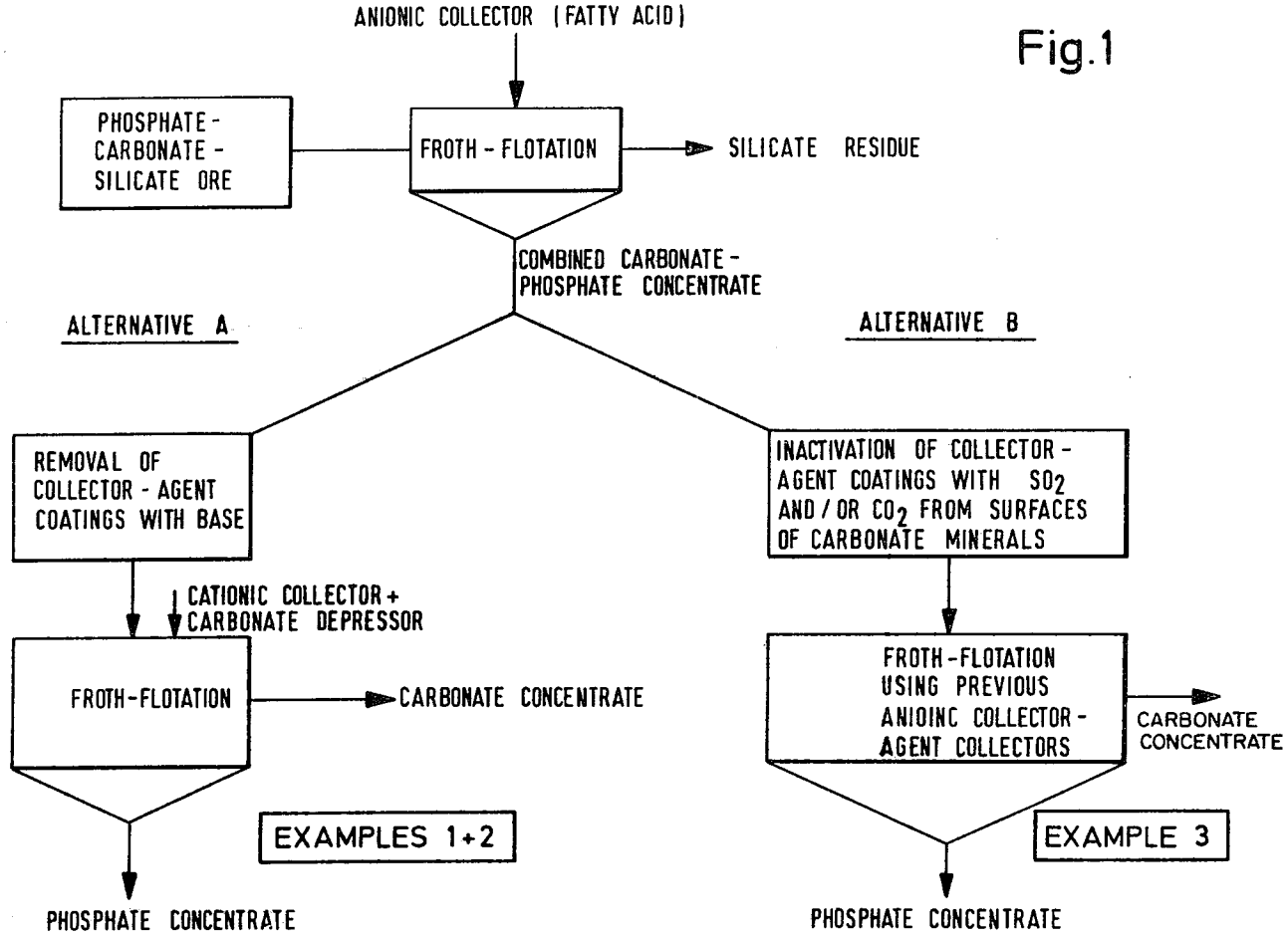
Figure 2:
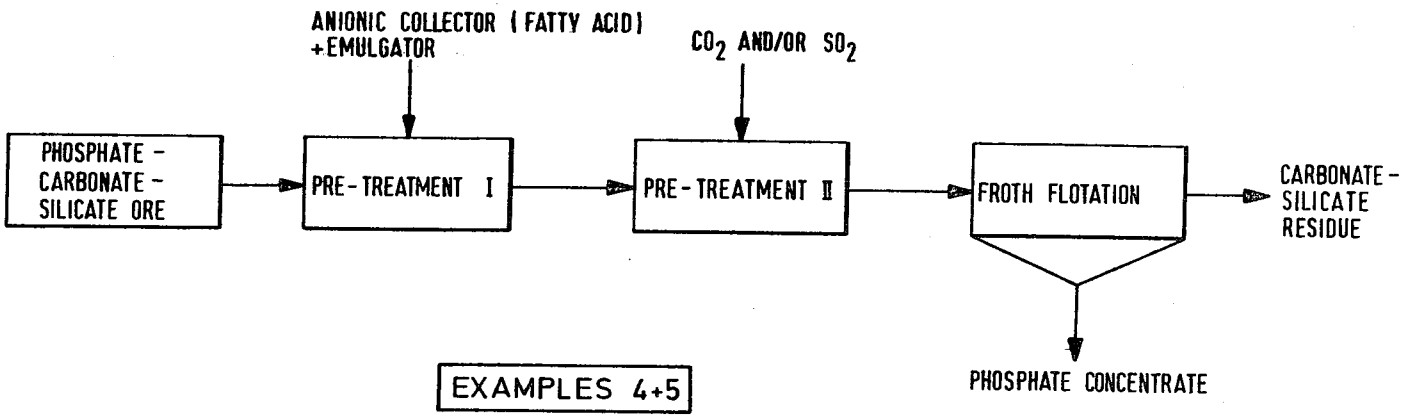

The invention is described below in more detail with the aid of examples, which are also illustrated with the flow diagrams shown in the accompanying drawings. Examples 1 and 2 below are in accordance with alternative A in FIG. 1, Example 3 is in accordance with alternative B in FIG. 1, and Examples 4 and 5 are in accordance with the flow diagram of FIG. 2.

EXAMPLE 1

The first example of results achieved by the present process consists of carbonate-apatite separation performed on a combined carbonate-apatite concentrate obtained by froth-flotation of apatite-carbonate-biotite ore with a fatty-acid collector agent. The composition of the ore was apatite: approx. 9%, carbonates: approx. 20%, and silicates: approx. 71%. The total combined concentrate amounted to approx. 18–20% by weight of the ore. The results are shown in Table 1 below.

TABLE 1

| | | Combined carbonate-apatite concentrate | Carbonate concentrate | Apatite concentrate |
|---|---|---|---|---|
| % by weight | | 18.6 | 5.6 | 13.0 |
| | $P_2O_5$ | 25.5 | 7.1 | 33.4 |
| Apatite | Concn. % | 61.2 | 17.1 | 80.2 |
| | Yield % | 100.0 | 8.4 | 91.6 |
| Carbonate | Concn. % | 34.1 | 74.4 | 16.8 |
| | Yield % | 100.0 | 65.5 | 34.5 |
| Silicate | Concn. % | 4.7 | 5.4 | 4.3 |
| | Yield % | 100.0 | 34.8 | 65.2 |

The following chemicals, listed in the order of addition, were used in this purification experiment:

| | | |
|---|---|---|
| $Ca(OH)_2$ | 2.4 kg/t | in additional grinding |
| $NH_4HF_2$ | 1 kg/t | in pre-treatment of the combined concentrate |
| $H_2SO_4$ | 1.5 kg/t | for pH control (pH = 6.5) |
| R-AminacT (amine collector agent, Raision Tehtaat Oy, Raisio) | 250 g/t | for froth-flotation of the apatite |

The result indicates that approx. 66% of the carbonates present in the combined carbonate-apatite concentrates were removed by this process without substantially decreasing the yield of apatite (loss of apatite into carbonate concentrate was approx. 8%). In this experiment, $Ca(OH)_2$ was used as the base and $NH_4HF_2$ as the carbonate-depressing agent, but substantial differences could not be observed in the test results even when replacing the calcium hydroxide with potassium, sodium, ammonium or barium hydroxide and by replacing the ammonium bifluoride with hydrofluoric acid, alum, quebracho, waterglass, and/or dichromate. In this experiment the base, $Ca(OH)_2$, was added to the additional grinding of the combined concentrate because the combined concentrate was too coarse for amine froth-flotation, but the base can just as well be added to the pre-treatment of the combined concentrate by wet-grinding as long as the combined concentrate is sufficiently fine-grained (approx. 40–60% $-74$ $\mu$m; no coarse apatite particles) considering the separation by froth flotation. The quantity of base in the additional grinding or pre-treatment by wet-grinding depends primarily on the density of slurry used (minimal quantity of water), since at this stage the pH should be approx. 11–12. 1–3 kg/t is usually sufficient. The quantity of ammonium bifluoride depends largely on the carbonate to apatite ratio in the combined concentrate—the higher the ratio the larger the quantity of ammonium bifluoride required for depressing the carbonates. In the experiment of the example, the said ratio was approx. 0.6, and therefore 1 kg of ammonium bifluoride was sufficient. The ratio being higher (1–2), the required quantity of depressor is approx. 2–4 kg/t and it is preferable to perform the separation in several stages, whereby the loss of apatite in the carbonate concentrate is considerably less than it would be using this ratio in one stage.

The quantity of amine collector agent is also somewhat larger in separation by several stages, 300–400 g/t. The quantity of sulfuric acid in this experiment was rather low (1.5 kg/t) because a change of water was performed after the base treatment of the combined concentrate, i.e. settling and removal of the basic water. In practice it is, however, easier to perform the process in such a manner that after the treatment with the base the pH of the slurry is lowered directly with sulfuric acid to approx. 8–9, since the removal of fatty-acid soaps, i.e., change of water, is not necessary, and thereafter the ammonium bifluoride is added. This drops the pH to the desired range, approx. 6.5–7, at which it is maintained by using sulfuric acid during the froth-flotation.

The experiment of the example was performed using a combined concentrate taken from the process of a pilot concentration plant. The superiority of the process according to the invention is shown in that an apatite concentrate of such a high concentration, i.e. $P_2O_5$ concentration 33.4%, has not been obtained by the conventional process used in the pilot concentration plant, but the concentration has usually been 28–30% $P_2O_5$. This process has a further advantage in its improved selectivity, i.e. the loss of apatite in the carbonate concentrate is approx. only 8%, while in the process used in the pilot concentration plant it is 10–15%. If the process of the pilot concentration plant is operated so as to obtain an equally high grade of concentrate, the loss of apatite is considerably higher.

EXAMPLE 2

The second example of the applicability of the present invention is the elevation of the concentration of a mixed phosphate-carbonate concentrate (lanthanide concentrate) froth-flotated with a fatty-acid collector agent. The result is shown in Table 2 below.

TABLE 2

| % by weight | | Mixed carbonate-phosphate concentrate 100.0 | Carbonate concentrate 65.0 | Phosphate concentrate 35.0 |
|---|---|---|---|---|
| | lanthanide oxide | 2.8 | 1.1 | 6.5 |
| Phosphates | $P_2O_5$ % | 8.3 | 2.2 | 20.0 |
| | Yield % | 100.0 | 14.4 | 85.6 |
| Carbonates | Concn. % | 45.5 | 66.8 | 6.0 |
| | Yield % | 100.0 | 95.4 | 4.6 |
| Silicates | Concn. % | 22.2 | 14.0 | 37.5 |
| | Yield % | 100.0 | 40.9 | 59.1 |

It can be seen from Table 2 above that the $P_2O_5$ concentration (lanthanide oxide concentration) in the mixed phosphate-carbonate concentrate was increased approx. 2.4-fold by this process by removing the carbonates (95%) from this concentrate without considerably decreasing the yield of phosphate (lanthanide). The loss of phosphate in the carbonate concentrate was approx. 15%.

The chemicals used in this experiment were the same as in Example, 1, and the quantities of the chemicals were approximately the same.

EXAMPLE 3

The elevation, by means of $CO_2$ and/or $SO_2$ treatment, of the concentration of an apatite concentrate obtained as a product of selective froth-flotation of apatite with a fatty-acid collector agent is the third example of results obtained by the process according to the invention. The result is shown in Table 3 below. The test material was the same ore as in Example 1.

TABLE 3

| % by weight | | Impure apatite concentrate 15.9 (100) | Carbonate concentrate 2.8 (17.6) | Purified apatite concentrate 9.2 (82.4) |
|---|---|---|---|---|
| | $P_2O_5$% | 19.4 | 3.6 | 31.1 |
| Apatites | Concn. % | 46.6 | 8.6 | 74.6 |
| | Yield % | 94.6 (100) | 7.4 (7.8) | 87.2 (92.2) |
| Carbonates | Concn. % | 48.3 | 86.1 | 25.0 |
| | Yield % | 39.7 (100) | 27.6 (69.5) | 12.1 (30.5) |
| Silicates | Concn. % | 3.5 | 6.0 | 0.5 |
| | Yield % | 0.76 (100) | 0.7 (92.1) | 0.06 (7.9) |

In the calculation of the above results the percentages by weight and the yield percentages have been calculated in percent of the ore. The percentages in parenthesis indicate the distribution in purification.

The results show that from an apatite concentrate froth-flotated with a good yield, 94.6%, in which the concentration of $P_2O_5$, 19.4%, is not satisfactory in itself, it was possible to remove approx. 70% of the carbonates by this process, whereby the concentration of the apatite concentrate increased 1.6-fold (from 19.4% to 31.1% $P_2O_5$), the loss of apatite being approx. only 8%.

The above experiment was performed as follows. The ore was ground to a suitable fineness, approx. 40%–200 mesh, by two-stage grinding in a shaking mill. In the froth-flotation of apatite thereafter performed, a rape seed oil fatty acid free from erucic acid was used at a rate of 200 g/t, its composition being oleic acid approx. 60%, linoleic acid 18%, linolenic acid 10%, and polyglycol ether 100 g/l as a carbonate-depressing agent. The impure apatite concentrate shown in Table 3 above was obtained by this froth-flotation. As mentioned above, the good yield causes a weak concentration, owing to the carbonates rising with the concentrates. In order to remove the carbonates, the impure apatite concentrate was treated with $CO_2$ by adding $CO_2$ at 2–3 kg/t to the pre-treatment, whereby the pH was lowered to 6.5–7. The concentrate was treated at this level of pH for approx. 5 min, whereafter it was possible to raise the pH with soda to 7–8; the rising of the pH is not necessary, but it can be used for accelerating the process. Thereafter a froth-flotation was performed, whereby the apatite frothed and the carbonates remained in the flotation residue. The carbonates remaining in the residue of the pre-flotation could easily be froth-flotated with any fatty-acid collector agent used at a rate of approx. 200–300 g/t. A final carbonate concentrate with a concentration of approx. 85–90% carbonates was obtained as follows: the pure carbonate product obtained by repeated froth-flotation of the latter product was combined with the said carbonate concentrate obtained from the purification of the apatite concentrate. The yield in the final product was approx. 70–80%.

By a process as simple and inexpensive as this it is possible to separate the apatite, carbonate and mica present in an ore into separate concentrates and to obtain high concentrations (purity degree approx. 75–98%) and good yields (70–95%).

The advantages of the process based on a selective froth-flotation of apatite and carbonates and a purification of apatite concentrate with $CO_2$ and/or $SO_2$ over conventional processes are its simplicity, low cost of reagents, and above all its good yields and high concentrations. The yield of apatite has conventionally been approx. 70–80%, but in the process according to the present invention it is approx. 85–90%, and the carbonate yield has conventionally been only 40–50%, but in the process according to the invention it is approx. 70–80%. Usually the selective froth-flotation of apatite mentioned above is successful without a carbonate-depressing agent only if the carbonate to apatite ratio is $\leqq 1.5$–2. In ores in which the said ratio is higher, it is advantageous to use $CO_2$ and/or $SO_2$ as a depressor for carbonate as early as in the pre-flotation. In this case the process operates as follows.

EXAMPLE 4

The fatty-acid collector agent and possibly an emulsifier are added to the pre-treatment, in which the pH is approx. 10.5, in the normal manner and preferably somewhat in excess, in order that all the phosphate-mineral surfaces receive a fatty-acid coating. The excess of the collector agent naturally results in part of the carbonates being froth-flotated together with the phosphates. In order to prevent this, the above-mentioned $CO_2$ and/or $SO_2$ treatment is performed in the manner described above. Thereby the collector-agent coatings can be selectively inactivated on carbonate surfaces, and as a result of this, a pure phosphate concentrate ($P_2O_5 \geqq 30\%$) is already obtained, with a good yield, at the pre-flotation. The addition of the collector agent and the $CO_2$ and/or $SO_2$ treatment can naturally also be performed in the reverse order, in which case, as a result of the $CO_2$ and/or $SO_2$ treatment, the fatty-acid collector agent does not cause the carbonate surfaces to become hydrophobic, and so only the phosphates are froth-flotated.

The results from the selective froth-flotation described above are shown in Table 4 below.

TABLE 4

| | | Apatite ore | Apatite concentrate (precon-centrate) | Carbonate concentrate | Residues from repeated froth-flotation | Residue (mica concen-trate) |
|---|---|---|---|---|---|---|
| % by weight | | 100 | 9.8 | 12.0 | 6.5 | 71.6 |
| | $P_2O_5$ % | 3.5 | 31.5 | 2.1 | 1.6 | 0.09 |
| Apatite | Concn. % | 8.4 | 75.6 | 4.4 | 3.8 | 0.22 |
| | Yield % | 100.0 | 88.3 | 7.2 | 2.7 | 1.8 |
| Carbonate | Concn. % | 15.4 | 20.0 | 94.2 | 20.1 | 1.2 |
| | Yield % | 100.0 | 12.8 | 73.9 | 7.7 | 5.6 |
| Silicate | Concn. % | 75.9 | 3.1 | 1.0 | 75.0 | 98.6 |
| | Yield % | 100.0 | 0.4 | 0.2 | 6.4 | 93.0 |

The following reagents were used in this experiment, their order of addition being the same as in the list:

| | |
|---|---|
| Froth-flotation of apatite | |
| Metasilicate<br>depressor for silicates in pre-flotation | 1000 g/t |
| Emulsifier alkyl-aryl (polyglycol ether)<br>depressor for carbonates together with $CO_2$ | 100 g/t |
| Aeropromoter 765 (a fatty-acid collector agent, American Cyanamid, U.S.A.) | 200 g/t |
| $CO_2$ gas (injected into the slurry)<br>depressor for carbonates | approx. 2000 g/t |
| Froth-flotation of carbonates | |
| Fatty-acid collector agent | 200 g/t |
| Metasilicate | 500 g/t |

The apatite concentrate of Table 4 was obtained using the former combination of reagents in selective one-stage froth-flotation. The carbonate concentrate was froth-flotated, using the latter combination of reagents, from the residue from the apatite froth-flotation. Obtaining a high-grade concentrate required 3 repeated froth-flotations.

EXAMPLE 5

The result obtained by selective froth-flotation of the phosphate minerals (apatite + monazite) from the phosphate-carbonate-silicate-bearing residue from the froth-flotation of lead is shown in Table 5 below.

TABLE 5

| | | Residue from Pb flotation | Phosphate (lanthanide) concentrate | Residue |
|---|---|---|---|---|
| % by weight | | 100 | 8.2 | 91.8 |
| | lanthanide oxide | 0.87 | 8.85 | 0.16 |
| Phosphates | $P_2O_5$ | 1.7 | 17.3 | 0.31 |
| | Yield % | 100.0 | 83.4 | 16.6 |
| Carbonates | Concn. % | 16.1 | 22.5 | 15.5 |
| | Yield % | 100.0 | 11.5 | 88.5 |
| Silicate | Concn. % | 76.0 | 19.1 | 81.1 |
| | Yield % | 100.0 | 2.1 | 97.9 |

The above result was obtained using a reagent combination similar to that used in the previous example, the only difference being that the quantity of the collector agent had been decreased in proportion to the phosphate concentrations in the initial materials. As regards the yield of phosphates, the result presented in this table does not substantially deviate from the results obtained by conventional processes, but as regards the grade of the concentrate, the difference is remarkable. The concentration of the concentrate obtained by this process is more than three-fold as regards phosphates (lanthanides), because by this process it is possible to froth-flotate the phosphates selectively, while the carbonates and the silicates remain in the slurry. This is a considerable advantage in terms of the cost of the process, since the results which can now be obtained by one froth-flotation stage are the same as those which required two additional stages in conventional processes, namely, the removal of carbonates by leaching with, for example, HCl and subsequent removal of silicates by froth-flotation. The carbonate-phosphate concentrate discussed in Example 2 is a product obtained by the conventional, unselective process. The weakness of conventional processes is also seen in the fact that in the above-mentioned mixed concentrate the lanthanide oxide ratio is lower than in the concentrate obtained by the process according to the present invention. This is so because in the conventional process the more important carrier mineral of lanthanides (monazite), in which the concentration of phosphorous is lower than in apatite, concentrates to a lesser degree than in the process illustrated in this example.

What is claimed is:

1. A process for the separate recovery of phosphate and carbonate materials from finely-divided phosphate-carbonate-silicate ores or concentrates with a carbonate to phosphate ratio of over 1, comprising adding an anionic collector agent to an aqueous slurry of these ores or concentrates; subjecting the slurry to froth-flotation in order to separate a silicate-bearing residue from a phosphate-carbonate concentrate; and then treating the phosphate-carbonate concentrate with sulfur dioxide or carbon dioxide or both in order to inactivate collector-agent coatings on the surfaces of the carbonate minerals, and finally subjecting the slurry to froth-flotation without adding any collector agent in order to separately recover a phosphate concentrate and a carbonate concentrate.

2. A process for the separate recovery of phosphate and carbonate minerals from finely-divided phosphate-carbonate-silicate ores or concentrates with a carbonate to phosphate ratio greater than 1, comprising adding an anionic collector agent to an aqueous slurry of these ores or concentrates; subjecting the slurry to froth-flotation in order to separate a silicate-bearing residue from a phosphate-carbonate concentrate; and then treating the phosphate-carbonate concentrate with sulfur dioxide or carbon-dioxide or both in order to inactivate the collector-agent coatings on the surfaces of the carbonate minerals, and finally lowering the pH and subjecting the slurry to further froth-flotation without adding any collector agent in order to separately recover a phosphate concentrate and a carbonate concentrate.

3. A process for the separate recovery of phosphate and carbonate minerals from finely-divided phosphate-carbonate-silicate ores or concentrates with a carbonate to phosphate ratio greater than 1, comprising adding an anionic collector agent to an aqueous slurry of these ores or concentrates; subjecting the slurry to froth-flotation in order to separate a silicate-bearing residue from a phosphate-carbonate concentrate, treating the phosphate-carbonate concentrate with a base at a raised pH of about 11–12 in order to remove collector-agent coatings from the surface of the mineral particles, and finally lowering the pH and subjecting the combined concentrate to further froth-flotation with a cationic collector agent, and using a depressing agent for carbonate in order to separately recover a phosphate concentrate and a carbonate concentrate.

4. The process of claim 3 in which the cationic collector agent is of the amine type, and the pH of the aqueous slurry is adjusted to be neutral or slightly acid in said further froth-flotation.

* * * * *